United States Patent [19]

Suga

[11] 4,142,127

[45] Feb. 27, 1979

[54] CONTROL MEANS FOR CONTROLLING THE POSITION OF AN ELECTRODE IN A CARBON ARC LAMP

[76] Inventor: Shigeru Suga, Yoyogi 5-20-2, Shibuya-ku, Tokyo, Japan

[21] Appl. No.: 825,856

[22] Filed: Aug. 18, 1977

[51] Int. Cl.[2] ..... H05B 31/18

[52] U.S. Cl. ..... 314/105; 314/93

[58] Field of Search ..... 314/3, 90, 93, 101, 314/102, 103, 98, 104, 105; 313/357, 238, 267

[56] References Cited

U.S. PATENT DOCUMENTS

| | | | |
|---|---|---|---|
| 473,076 | 4/1892 | Patin | 314/98 X |
| 1,007,435 | 10/1911 | Dooley | 314/105 X |

*Primary Examiner*—R. N. Envall, Jr.

*Attorney, Agent, or Firm*—Wenderoth, Lind & Ponack

[57] ABSTRACT

An improved control system for controlling the position of an upper electrode in a carbon arc lamp. The system has a pulley with a line thereover, and a solenoid core is attached to one end of the line and is movable vertically in a solenoid coil connected in the circuit for supplying discharge current to the electrodes, and a control rod clutch is connected to the other end of the line which normally grasps and holds an electrode control rod on the lower end of which is mounted the upper electrode of the lamp. A balancing weight is provided on the core to balance the weight of the control rod clutch and electrode and a shield is provided around the solenoid coil to shield the arc between the electrodes from the magnetic field of the solenoid coil.

6 Claims, 10 Drawing Figures

CONTROL MEANS FOR CONTROLLING THE POSITION OF AN ELECTRODE IN A CARBON ARC LAMP

The present invention relates to an improvement in means for controlling the discharge arc of a carbon lamp which is used, for example, in measuring the fastness of a sample material to light.

BACKGROUND OF THE INVENTION AND PRIOR ART

A conventional arc lamp and its associated parts typically include, as shown in FIGS. 1–3, a U-shaped core 2 having two upstanding legs extending into and adapted to be actuated by respective magnet coils 1, and an upper electrode 3. The core 2 and the upper electrode 3 are connected to each other by means of a spring 4' around a vertical rod 4 and having the lower end connected to the cross-piece of the U-shaped core by leaf springs 4", a zig-zag angle link 5 having a horizontal portion extending through rod 4, and a ring clutch 6 at the lower end of the link 5 for gripping the upper electrode 3.

The magnetic coils 1 move the cores up when they are supplied with the current to the electrodes, so as to cause an upward and downward movement of the upper electrode within a bushing 7' provided in the center of the closure plate 7 closing the glass enclosure L of the lamps, when the current is interrupted and restarted thereby to control the distance between the upper electrode 3 and a lower electrode 9, and thus control the arcing of the lamp.

In this conventional arrangement, the coil spring 4' and leaf spring 4" are provided for preventing the vibration of the core 2 from being transmitted to the link 5 as much as possible. However, these springs often fail to cut the transmission of the vibration, due to differences in frequencies, or due to possible resonance at a specific frequency of vibration. In such a case, the vibration is transmitted through the link to the electrode and vibrates the electrode, resulting in a fluctuation in the arc. An air damper or a dash pot 8 can be connected to the upper end of the link 5 for preventing the vibration, but does not provide a completly satisfactory damping effect, especially for lateral components of the vibration.

In addition, the upstanding legs of the core, in the two coils inconveniently tend to be swung laterally so as to swing the link 5 laterally, biasing the upper electrode 3 laterally and causing it in contact the wall of the bushing 7'. Consequently, the friction between the bushing 7' and the carbon electrode 3 increases, or the electrode 3 binds in the bushing, causing a deterioration of the control of the position of the upper electrode 3.

Further that the strength of the magnet coils 1 must be uneconomically large in order that they are able to lift the combined weight of the electrode 3, the core 2, and the link 5 and other associated members.

Another problem inherent in the conventional arrangement is that the arcing is stronger on the side of the electrodes on the opposite side of the center line thereof from the magnet coils 1, as shown in FIG. 4, resulting in fluctuating arcing and an uneven consumption of the electrodes as represented by the oblique ends 12 and 12' of the electrodes in FIG. 4. This is due to a repulsion force between the arc and magnetic lines of force produced by the magnet coils 2 as represented by the arrows 11 in FIG. 4. At the same time, since the conventional structure of the core cannot provide a good shielding effect, interference with the core is likely to occur.

OBJECT AND BRIEF SUMMARY OF THE INVENTION

The present invention has as its object to provide means for overcoming above described problems or shortcomings of the prior art apparatus.

To achieve this object the present invention provides means for controlling the discharge arc of a carbon arc lamp in which the connection between the upper electrode and a core in a discharge controlling magnet coil is by a wire and a pulley, so as to prevent vibrations generated in the core from being transmitted to the electrode, whereby stable arcing is achieved.

According to another aspect of the present invention, a core in a discharge controlling magnet coil is provided with a weight so that the force required for control of the clutch can be reduced, thereby making it possible to reduce the size of the magnet coil.

According to still another aspect of the invention, the bottom portion of a discharge controlling magnet coil is shielded to block escape of magnetic lines of force, so as to avoid any undesirable effect on the magnetic field of the discharge arc. thereby stabilizing the arcing.

The present invention thus provides improved means for controlling discharge arcing having advantageous features and a performance which can not be achieved by conventional controlling means.

BRIEF DESCRIPTION OF THE FIGURES

This and other objects and advantageous features of the present will become clear from the following description of preferred embodiments, taken in conjunction with the attached drawings, in which.

DETAILED DESCRIPTION

Figure 5:
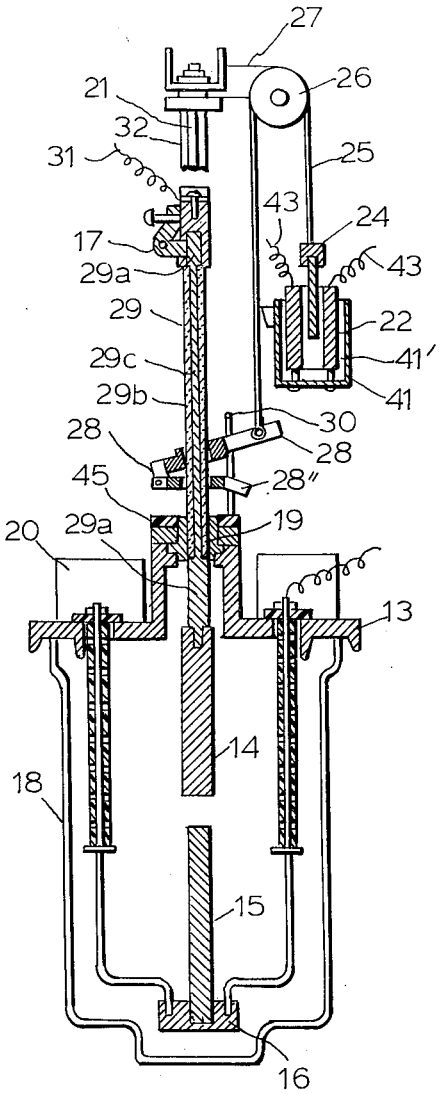
FIG. 5 is a sectional elevation view of a carbon arc lamp having discharge controlling means according to the present device.
Figure 6:
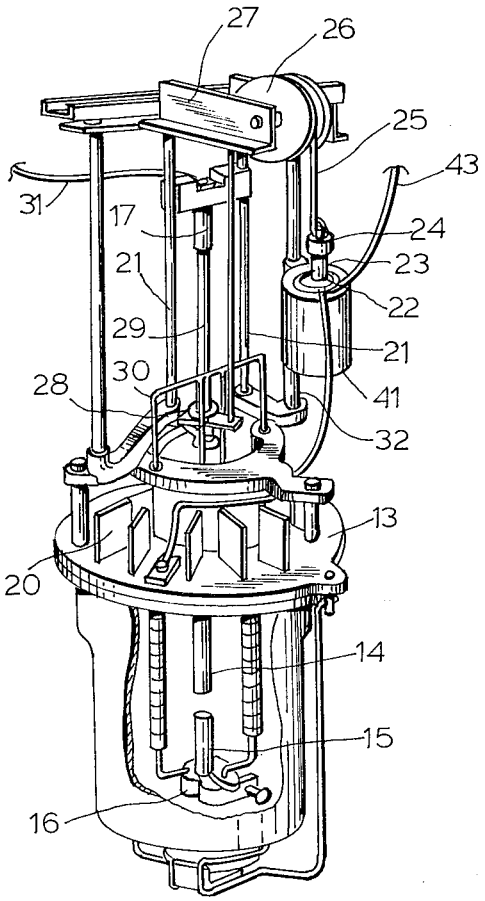
FIG. 6 is a perspective view partly broken away of the carbon arc lamp of FIG. 5.

As shown in FIGS. 5 and 6, the lamp comprises, similarly to conventional discharge lamps, a closure plate 13, upper and lower electrodes 14 and 15, a lower electrode holder 16, an upper electrode holder 17, a glass enclosure 18, a control rod guiding bushing 19, guide rods 21 for guiding the upward and downward movement of the electrode holder 17, an electric circuit, and heat radiation fins 20 for removing heat from the enclosure 18 and plate 13.

The lower electrode 16 is mounted on the stationary holder 16 suspended from the cover plate 13, while the upper electrode 14 is threadedly secured at its upper end to an electrode control rod 29. The electrode control rod 29 has metallic upper and a lower end portions **29*a* and an intermediate portion 29*b* of an insulating material such as a glass tube, accomodating a conductive wire or rod 29*c* connecting the upper and lower metallic end portions 29*a*. The electrode control rod 29 is connected to the electric circuit by lead wire 31 connected to the holder 17. The control rod 29 is slidingly accommodated in the bushing 19 in the center of the base plate 13. The upper electrode holder 17 is slidably guided along a pair of guide rods 21**.

The discharge controlling means of the invention comprises a solenoid coil 22, an ion core 23 displaceable within the coil 22, a balancing weight 24 attached to the upper end of core 23, a wire 25 attached to weight 24 and extending over a pulley 26 mounted in supporting means 27 to a ring-shaped control rod clutch 28 around the control rod 29.

The coil 22 is mounted in a shielding container 41 made of highly magnetically permeable material such as pure ion, and the container 41 is secured to a column 32. The shielding container 41 confines the magnetic field produced by the coil 22 to the container. The upper end of the shielding container 31 is open to receive the core 23. A suitable annular space 41' is provided between the wall of the container 41 and the peripheral surface of the coil 22 for permitting magnetic lines of force having sufficient intensity to actuate the core to pass therethrough.

Figure 1:
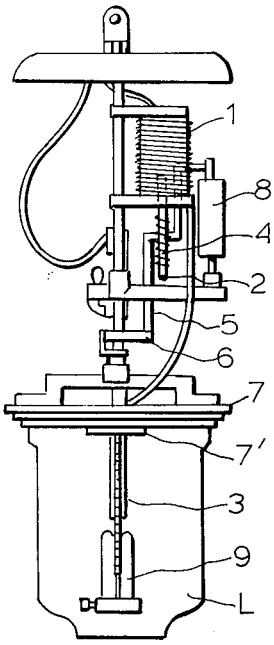
(PRIOR ART) FIG.1
FIG. 1 is a side elevation view of a conventional carbon arc lamp.
Figure 2:
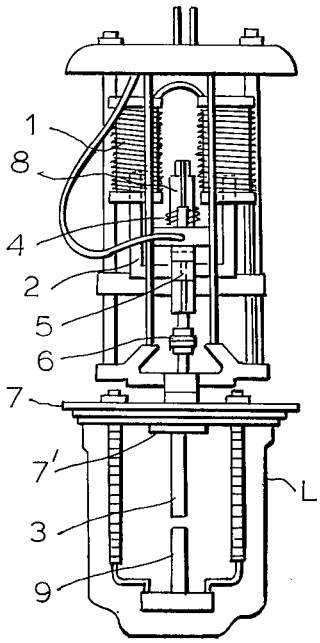
(PRIOR ART) FIG.2
FIG. 2 is a front elevation view of the carbon arc lamp of FIG. 1.
Figure 3:
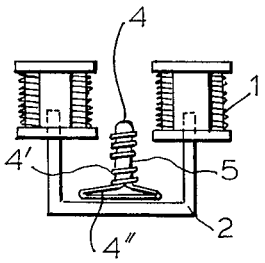
(PRIOR ART) FIG.3
FIG. 3 is an enlarged elevation view of a part of conventional discharge controlling means for the lamp of FIGS. 1 and 2.
Figure 4:
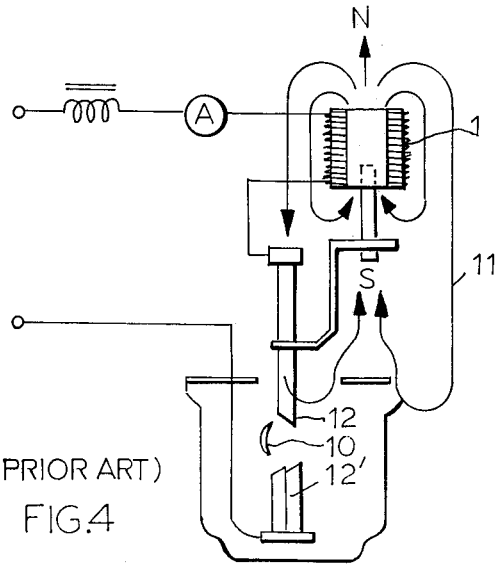
(PRIOR ART) FIG.4
FIG. 4 is a schematic illustration of the conventional arc lamp and the electrical circuit thereof for explaining the influence of magnetic lines of force on the arc.

The coil 22 is connected to the electric circuit by leads 43 in a manner similar to the conventional arrangement shown in FIG. 4, so as to be supplied with the electrode current.

Figure 7:
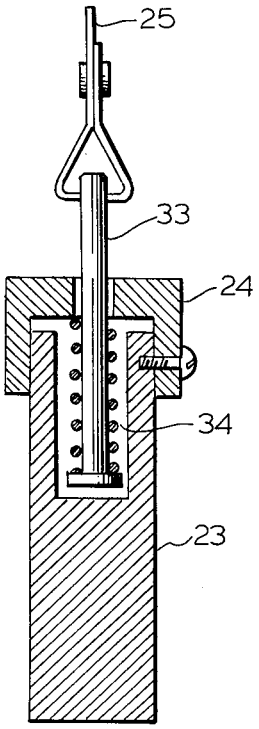
FIG. 7 is a detailed sectional view of a core having a balancing weight according to the present invention.

As shown in detail in FIG. 7, the core 23 disposed centrally in the coil 22 has a damping spring 34 in a recess in the upper end thereof. The weight 24 is secured over the upper end of core 23, and a rod-like metal member 33 connected to the end of the wire 25 extends into the recess through a hole in the balancing weight and engages the inner end of damping spring 34. The wire 25 goes round the pulley 26 and is connected at its other end to the ring-shaped rod clutch 28. The mass or weight of the balancing weight 24 is so selected as to cause a movement of the wire 25 round the pulley such that the upper carbon electrode 14 attached to the control rod 29 is lowered gradually when the coil 22 is not energized. When the discharge current is supplied to the electrodes flows in the coil 22, the upper carbon electrode is moved up by the aforementioned parts.

Figure 8:
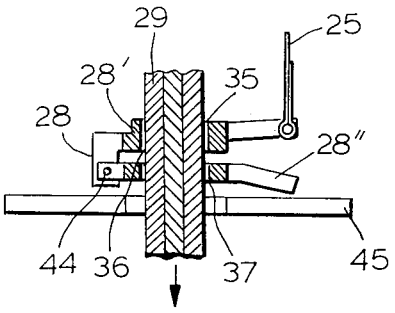
FIG. 8 is a sectional elevation view of an electrode holder and an electrode controlling rod in the released condition therein.
Figure 9:
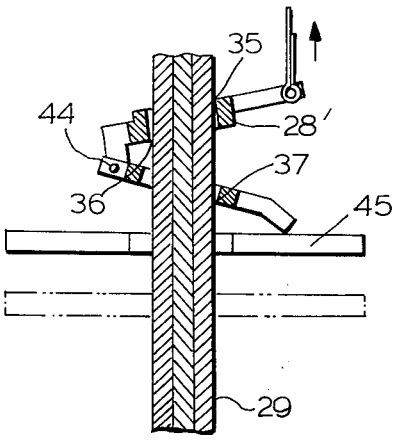
FIG. 9 is a view similar to FIG. 8 showing the electrode controlling rod held by the electrode holder.
Figure 10:
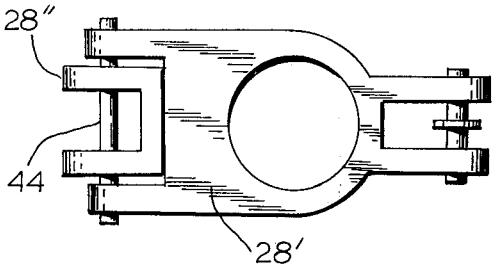
FIG. 10 is a top plan view of the electrode holder.

Referring to FIGS. 8 and 9, which show the manner in which the electrode control rod 29 is held by the ring-shaped rod clutch 28, the ring-shaped rod clutch 28 consists of upper and a lower halves 28' and 28'' which are pivotally secured to each other by shaft 44, as most clearly seen from FIG. 10. The halves 28' have apertures 35 and 37 therein each having a diameter slightly larger than that of the electrode control rod 29. The combined weight of the clutch 28, rod 29 holder 17, and electrode 14 is greater than the combined weight of the core 23 and balancing weight 24.

When the electrical power supply to the coil 22 is interrupted due to the arc being extinguished, the clutch 28 holding the electrode control rod 29 is free to move downwardly because no attractive force is exterted on the core 23 by coil 22. Downward movement continues until the free end of the lower half 28'' of the clutch comes into contact with an insulating plate 45 by which the bushing 19 is secured to the cover plate 13. As the clutch 28 is lowered further, downward movement of the free end of the lower half 28'' is prevented and the upper and the lower halves 28' and 28'' become parallel with each other, as shown in FIG. 8, leaving the control rod 29 free within the clutch 28. This permits the electrode control rod 29 to drop freely until the lower end of the upper electrode 14 comes into contact with the lower electrode 15. At this point the weight of the upper electrode and the electrode control rod is borne by the lower electrode and the combined weight of the core 23 and balancing weight 24, being greater than that of the clutch 28 alone, causes the free end of the upper half 28' of the clutch 28 to be lifted until the edges of the apertures of the upper end and lower halves 28' and 28'' contact the electrode control rod 29 as shown in FIG. 9. Thus, with the upper and the lower electrodes in contact with each other, the relative positions of the clutch 28 and the insulating plate 44 are as shown in full lines in FIG. 9.

With the electrode parts in contact, the power commences to flow in the circuit again, and the coil 22 is energized to draw core 23 into the coil. This exerts sufficient force on the wire 25 to raise the clutch 28 and the control rod 29 so that the upper electrode 14 is moved upwardly away from the lower electrode 15 to initiate electric arc discharge therebetween.

The number of turns of the coil 22 is selected so as to raise the upper electrode a distance to commence electric discharge at a predetermined magnitude of the discharge current. A constant discharge current of this magnitude will be maintained because the distance between the electrodes will automatically change in accordance with a change in the current. If the discharge current is increased, the distance between the electrodes is automatically increased due to an increased force exerted by the magnet coil which draws the core 22 further into the coil 23, thus raising the control rod, while if the distance between the electrodes increases, the discharge current is correspondingly decreased, weakening the force exerted by this magnet coil 22 on the coil 23, allowing the control rod to move down to decrease the distance.

A decrease of the discharge current can be automatically compensated for by the reverse sequence of actions.

As the carbon electrode is consumed to a point beyond which automatic discharge current control can be carried out, the power supply is again interrupted to cause the free fall of the electrode control rod 29. Then, as described above, the electrode control rod 29 is gripped by the clutch 28 at a new position above the position at which it was previously held. Arcing is again started automatically with a new length of upper electrode available for consumption and with the parts in the positional relationships similar to those at the start of the arcing.

In FIGS. 5 and 6, a reference numeral 30 denotes a stop for limiting the upward movement of the electrode holder 28. This is effective to prevent an excessive upward displacement of the clutch 28 when it is removed for the purpose of a manual replacement of the carbon upper electrode.

The following advantageous effects are achieved by the above described structural features of the present device.

First of all, the discharge arc is free from the effect of the magnetic field produced by the coil 22 due to the provision of the shielding means in the form of shielding container 41. Consequently, a more stabilized arcing is maintained, and uniform consumption of the electrode is ensured, this avoiding the aforementioned oblique shape of the ends of the electrodes.

Another advantage is that the controlling means are more free from the effect of lateral swinging of the core 23 in the coil 22. This is due to the adoption of a single coil structure, which is in contrast to the conventional arrangement employing two coils which has inevitably caused such lateral swinging because of the existence of unequal gaps between the coils and the cores of the coils. Only a small lateral swinging can take place in the device of the present invention, and even this is not transmitted to the electrode due to the flexible nature of the connecting means consisting of a wire and a pulley. The wire and pulley connection is also effective to prevent the vertical component of the vibration of the core from being transmitted to the electrode thereby providing a more stabilized arcing as compared to the conventional arrangement employing a link as the connecting means.

In conventional discharge control means which has link type connecting means, the force for pulling the link upward varies in accordance with the distance between the core and the magnet coils and with the condition of contact between the link and the springs. At the same time, when a lateral force causes the electrode control rod to move laterally the discharge arcing tends to get out of control due to the binding of the electrode control rod to the bushing.

In contrast thereto, according to the present device, a constant pulling force on the holder 28 is ensured due to the use of the connecting means consisting of a wire and a pulley around which the wire extends. This makes possible a stable control of the discharge arcing.

A further advantage of the invention is that the force required for raising the electrodes control rod carrying the electrode is reduced due to the use of the balancing weight. Consequently, the solenoid coil can be made smaller than heretofore. It has been found possible to provide a magnet coil having a capacity which is only 37% of that required for the conventional arrangement, thereby reducing the power consumption of the device of the present invention as well as its manufacturing cost.

What is claimed is:

1. In a carbon arc lamp having a transparent enclosure with a lower electrode therein and a cover plate over the enclosure through which an electrode control rod held in a holder slidably extends for holding an upper electrode in the enclosure, and an electric circuit for supplying arc discharge current across said electrodes, an improved control means for automatically adjusting the vertical position of said electrode control rod for automatically starting the arc if it has been extinguished and for compensating for consumption of the upper electrode during normal use, said control means comprising: a pulley on said lamp above the level of said control rod, a line over said pulley and hanging downwardly therefrom, a magnetic core on one end of said line, a solenoid coil connected in the electric circuit and within which said core is movable for pulling the core downwardly into the solenoid coil as discharge current increases, a rod clutch on the other end of said line and above said cover plate in which said control rod is normally gripped and for releasing said control rod for vertical downward movement through said rod clutch when the rod clutch descends sufficiently to contact the cover plate.

2. The improvement as claimed in claim 1 further comprising a shield of a highly magnetically permeable material around and spaced from said solenoid coil for shielding the magnetic field of said solenoid coil from the arc between said electrodes.

3. The improvement as claimed in claim 1 further comprising a balancing weight on said line on the side on which said core is mounted for substantially balancing, when added to the weight of said core, the combined weight of said rod clutch, said control rod and holder therefor and said upper electrode.

4. The improvement as claimed in claim 3 in which said counter weight is mounted on said core.

5. The improvement as claimed in claim 4 in which said core is resiliently mounted on said line.

6. The improvement as claimed in claim 1 in which said rod clutch comprises an upper and a lower ring shaped portion having apertures therethrough slightly larger than the control rod diameter, said portions being pivotally connected at a point offset from the axis of the control rod, said line being attached to the end of the upper portion on the opposite side of the control rod from the pivotal connection to the lower portion, and the corresponding other end of the lower portion being engagable with the cover plate as the clutch and the control rod are moving downwardly to cause the portions to pivot until they are parallel to each other, thereby permitting the control rod to move through the apertures.

* * * * *